United States Patent [19]

McReynolds

[11] 4,225,383

[45] Sep. 30, 1980

[54] HIGHLY FILLED SHEETS AND METHOD OF PREPARATION THEREOF

[75] Inventor: Kent B. McReynolds, Midland, Mich.

[73] Assignee: The Dow Chemical Company, Midland, Mich.

[21] Appl. No.: 969,749

[22] Filed: Dec. 14, 1978

Related U.S. Application Data

[63] Continuation-in-part of Ser. No. 874,458, Feb. 2, 1978, abandoned.

[51] Int. Cl.[2] ..... D21H 5/18

[52] U.S. Cl. ..... 162/156; 162/145; 162/146; 162/157 R; 162/168 R; 162/169; 162/183

[58] Field of Search ..... 162/168 R, 169, 181 R, 162/183, 146, 145, 157 R, 156; 260/42.17, 42.55, 42.18, 42.32

[56] References Cited

U.S. PATENT DOCUMENTS

| | | | |
|---|---|---|---|
| 2,474,801 | 6/1949 | Owen | 92/3 |
| 2,657,991 | 11/1953 | Walsh et al. | 162/169 |
| 3,021,257 | 2/1962 | Stauffenberg | 162/162 |
| 3,193,446 | 7/1965 | Eisenberg | 162/145 |
| 3,223,580 | 12/1965 | Eckert et al. | 162/145 |
| 3,640,922 | 2/1972 | Sheetz | 260/23 EM |
| 3,732,177 | 5/1973 | Tisdale et al. | 260/42.18 |
| 3,937,648 | 2/1976 | Huebner et al. | 162/169 |
| 4,011,094 | 3/1977 | Burley | 106/93 |
| 4,024,014 | 5/1977 | Akerson | 162/181 R |
| 4,039,492 | 8/1977 | Hamilton | 260/17 R |
| 4,056,501 | 11/1977 | Gibbs et al. | 260/27.6 HN |
| 4,144,121 | 3/1979 | Otouma et al. | 162/145 |

FOREIGN PATENT DOCUMENTS

| | | | |
|---|---|---|---|
| 2516097 | 11/1975 | Fed. Rep. of Germany . | |
| 7620635 | 7/1976 | France . | |
| 45-8164 | 3/1970 | Japan . | |
| 818652 | 8/1959 | United Kingdom | 162/169 |
| 952037 | 3/1964 | United Kingdom | 162/181 R |

OTHER PUBLICATIONS

Calkin, "Modern Pulp and Papermaking", 3rd ed., (1957), pp. 312 & 313.

Kirk-Othmer, "Encyclopedia of Chem. Tech.", vol. 14, 1967, pp. 494–510.

*Primary Examiner*—S. Leon Bashore

*Assistant Examiner*—Peter Chin

*Attorney, Agent, or Firm*—I. A. Murphy

[57] ABSTRACT

A sheet which is a composite of (A) from about 1 percent to about 30 percent of a water-dispersible fiber such as wood fiber, (B) from about 2 percent to about 30 percent of a film-forming, water-insoluble, organic polymer such as a copolymer of styrene and butadiene and (C) from about 60 percent to about 95 percent of a finely-divided, substantially water-insoluble, non-fibrous, inorganic filler such as magnesium hydroxide is prepared by steps comprising:

(I) providing an aqueous dispersion of the fiber;

(II) mixing therewith (A) the inorganic filler and (B) the organic polymer in the form of an ionically stabilized latex;

(III) colloidally destabilizing the resulting mixture to form a fibrous agglomerate in aqueous suspension;

(IV) distributing and draining the aqueous dispersion on a porous substrate such as a wire to form a wet web; and (V) drying the web.

24 Claims, No Drawings

HIGHLY FILLED SHEETS AND METHOD OF PREPARATION THEREOF

CROSS-REFERENCE TO RELATED APPLICATIONS

This application is a continuation-in-part of Application Ser. No. 874,458 filed Feb. 2, 1978 abandoned.

BACKGROUND OF THE INVENTION

1. Field of the Invention

The invention is concerned with pigmented, nonwoven, fibrous sheets, particularly highly filled sheets having a low fiber content.

2. Description of the Prior Art

Paper has been described as a sheet material made up of many small discrete fibers (commonly cellulosic) bonded together. Small amounts of latex have been used in the paper making process. Fillers have also been used to improve certain properties of the paper even though the strength of the sheet is thereby reduced. The amount of fillers heretofore used in paper making processes on common equipment such as the Fourdrinier machine generally has not been greater than 30 or 35 percent of the total dry weight of the sheet, although up to 40 percent has been disclosed as operable. The retention of fillers in the sheet during formation has been recognized as a significant problem.

The use of asbestos in the preparation of other kinds of fibrous sheets has been practiced for many years. Such fibrous sheets have been used advantageously in the preparation of products such as floor coverings and muffler paper. However, evidence has been found that asbestos fibers are injurious to human health. In some countries, the use of asbestos has been banned and in the United States rather severe restrictions on its use are being comtemplated. Accordingly, new systems which do not use asbestos are greatly desired. Such new asbestos-free systems can advance the state of the art even though on balance their properties do not exceed those of the asbestos-containing materials. Where the properties or methods of preparation are improved, such systems would be of great benefit.

It would be especially advantageous if a new process for making highly filled papers and especially asbestos-free products could be carried out on existing equipment so that large, new capital investments would not be required.

SUMMARY OF THE INVENTION

The process and product of this invention includes the combination of a water-dispersible fiber, a film-forming, water-insoluble, organic polymer and an inorganic filler in the form of a water-laid sheet. One method of forming such a sheet is by:

(I) providing an aqueous dispersion of from about 1 percent to about 30 percent, preferably from about 5 to 15 percent, of a water-dispersible fiber;

(II) mixing therewith (A) from about 60 percent to about 95 percent, preferably from about 75 to 90 percent, of a substantially water-insoluble, non-fibrous, inorganic filler, and (B) from about 2 percent to about 30 percent, preferably from about 5 to 15 percent, of a film-forming, water-insoluble, organic polymer in the form of an ionically stabilized latex, i.e., an aqueous colloidal dispersion of a substantially water-insoluble, organic polymer, having not greater than about 0.7 milliequivalent, preferably from about 0.03 to about 0.4 milliequivalent, of bound charge per gram of polymer in the latex;

(III) colloidally destabilizing the resulting mixture to form a fibrous agglomerate in aqueous suspension;

(IV) distributing and draining the aqueous suspension on a porous substrate such as a wire to form a wet web; and (V) drying the web.

Significant features of the process and product are a low proportion of fiber and a high proportion of inorganic filler as well as good runnability of the process on common paper-making equipment and the good properties of the product. The preferred highly filled, water-laid, fibrous, asbestos-free sheets are suitable as a replacement or substitute for asbestos sheets in many of their applications but are not restricted to such uses. Representative uses of the sheets are as muffler paper, underlayment felt for vinyl floor covering, gasket papers, roofing paper, sound-deadening paper, pipe wrap, insulation paper, heat deflection papers, cooling tower packing, electrically resistant paper and board products.

DESCRIPTION OF THE PREFERRED EMBODIMENTS

The product and process of this invention requires a water-dispersible fiber, a film-forming, water-insoluble, organic polymer and a finely-divided, substantially water-insoluble, non-fibrous, inorganic filler. In the preferred process, a flocculating agent also is required.

The fiber is any water-insoluble, natural or synthetic water-dispersible fiber or blend of such fibers. Usually water-dispersibility is provided by a small amount of ionic or hydrophilic groups or charges which are of insufficient magnitude to provide water-solubility. Either long or short fibers, or mixtures thereof, are useful, but short fibers are preferred. Many of the fibers from natural materials are anionic, e.g., wood pulp. Some of the synthetic fibers are treated to make them slightly ionic, i.e., anionic or cationic. Glass fibers, chopped glass, blown glass, reclaimed waste papers, cellulose from cotton and linen rags, mineral wool, synthetic wood pulp such as is made from polyethylene, straws, ceramic fiber, nylon fiber, polyester fiber, and similar materials are useful. Particularly useful fibers are the cellulosic and lignocellulosic fibers commonly known as wood pulp of the various kinds from hardwood and softwood such as stone ground wood, steam-heated mechanical pulp, chemimechanical pulp, semichemical pulp and chemical pulp. Specific examples are unbleached sulfite pulp, bleached sulfite pulp, unbleached sulfate pulp and bleached sulfate pulp.

The film-forming, water-insoluble, organic polymer useful in the practice of this invention is natural or synthetic and may be a homopolymer, a copolymer of two or more ethylenically unsaturated monomers or a mixture of such polymers. Particularly for ease of processing to make the product and for limiting the loss of pollutants to the surroundings, it is generally advantageous that the polymer is in the form of a latex, i.e., an aqueous colloidal dispersion. Representative organic polymers are natural rubber, the synthetic rubbers such as styrene/butadiene rubbers, isoprene rubbers, butyl rubbers and nitrile rubbers and other rubbery or resinous polymers of ethylenically unsaturated monomers which are film-forming, preferably at room temperature or below, although in a particular instance a polymer may be used which is film-forming at the temperature used in preparing that sheet. Non-film-forming polymers may be used in blends provided that the resulting blend is film-forming. Polymers which are made film-forming by the use of plasticizers also may be used. Polymers which are readily available in latex form are preferred—especially hydrophobic polymers which are prepared by emulsion polymerization of one or more ethylenically unsaturated monomers. Representative of such latexes are those described in U.S. Pat. No. 3,640,922, David P. Sheetz, from column 1, line 61, to column 2, line 34. That passage (particularly column 2, lines 2–9) indicates a preference for latexes of polymers and copolymers not having a substantial proportion of hydrophilic groups. For use in the present invention, the latexes preferably have some ionic hydrophilic groups but must be devoid of sufficient non-ionic colloidal stabilization which would interfere with formation of the fibrous agglomerate. Such non-ionic, collodial stabilization could be provided by non-ionic emulsifiers or by the presence of copolymerized monomers having the kinds of hydrophilic groups as are found in non-ionic emulsifiers, for example, hydroxyl and amide groups. Thus, if monomers having such hydrophilic groups are polymerized constituents of the latex polymers, such monomers will be present in small proportions such as less than about 10 percent, usually less than about 5 percent of the polymer weight for best results. Also, while very small amounts of non-ionic emulsifiers can be tolerated in some compositions, their use ordinarily is not advantageous and they should not be used in amounts sufficient to interfere with the destabilization step of the process.

Latex compositions for use in this invention are selected from latexes in which a polymer of the foregoing description is maintained in aqueous dispersion by ionic stabilization. Such ionic stabilization is obtained, for example, by use of an ionic surfactant or small amounts of a monomer containing an ionic group during emulsion polymerization to prepare the latex. The small amount of ionic groups which are bound to the polymer generally will provide less than about 0.7 milliequivalent of charge per gram of polymer in the latex. Ordinarily it is preferred that the latex component for this invention have a charge bound to the polymer of from about 0.03 to about 0.4, especially from about 0.09 to about 0.18, milliequivalent per gram of polymer in the latex, particularly when the charge is provided by carboxylic salt groups. The term "bound to the polymer" with respect to ionic groups or charges refers to ionic groups or charges which are not desorbable from the polymer. Materials containing such ionic groups or charges may be obtained as noted above by copolymerization of a monomer containing ionic groups or by other ways such as grafting, by attachment (through covalent bonds) of catalyst fragments to the polymer, especially sulfate groups from persulfate catalysts, or by the conversion to ionic groups of non-ionic groups already attached to the polymer by covalent bonds.

The ionic groups advantageously are the carboxyl salt groups, especially the alkali metal and ammonium carboxylate groups, or quaternary ammonium salt groups, but other anionic and cationic groups are useful; for example, sulfate, sulfonate and amino groups. Carboxyl salt groups are especially advantageous.

For latex compositions having little or no detectable amount of ionic groups bound to the polymer, the ionic stabilization is provided by adsorbed ionic surfactants. Small amounts of ionic surfactant can be used with latexes having bound ionic groups but increasing amounts of surfactants above the amounts required for adequate stabilization tend to make proper selection of other components of the system more critical and complicate the formulation.

Anionic and cationic surfactants are well known in the art and suitable materials of those classes can be selected, for example, from among those listed in the annual issues of "McCutcheon's Detergents and Emulsifiers" such as the 1973 issue, published by McCutcheon's Division, Allured Publishing Corporation, Ridgewood, N.J. Examples of non-ionic surfactants are also provided in the above-noted reference.

The especially preferred latexes (i.e., latexes having from about 0.09 to about 0.18 milliequivalent of bound charge per gram of polymer) generally work best in the process and provide overall the best composite sheet. When these especially preferred latexes are used in the process, the procedure for the colloidal destabilizing step as well as the selection of the amount and kinds of the other ingredients within the limits described herein are less demanding. With such latexes, observation of the behavior during the process provides guidance for selections of the various other components for use when it is desired to use latexes within the preferred and operable limits but outside the especially preferred limits. For illustration, in carrying out the colloidal destabilizing step by the method using a flocculant opposite in charge to the latex, the appearance and nature of the resulting flocculated material when using the especially preferred latexes will guide the skilled in the art in the critical selection of the other components when a latex outside the especially preferred but within the operable limits is used—especially with the higher bound charge latex.

There are instances where for particular purposes, however, it is preferred to use the latexes having a bound charge above 0.18 and even above 0.4 milliequivalent of charge per gram polymer in the latex, e.g., where the bound charge is cationic, where rebrokability of the composition is desired, or where the bound ionic groups in addition to their stabilization role are desired in larger amounts to perform other advantageous interactions with other components of the composition.

The charge/mass ratio, expressed herein as milliequivalents of charge per gram of polymer in the latex, does not necessarily (and generally does not) correspond, for example, to the proportion of milliequivalents of monomer containing an ionic group which is copolymerized with the non-ionic, hydrophobic monomers by emulsion polymerization to form the latex. These differences arise (1) because some of the ionic monomer is polymerized inside a latex particle and thus is not effective in stabilizing the dispersion of polymer particles and is not measured, (2) the ionic monomer may homopolymerize or copolymerize to form varying amounts of water-soluble polymers, or (3) in some instances the ionic monomer does not polymerize as completely as the other monomers. In general, as the proportion of the ionic monomer in relation to the total monomer increases, the proportion of the ionic groups of the ionic monomers which are on the surface of the particle decreases and the amount buried within the latex particles or which forms ionic water-soluble polymers increases. Since too large an excess of water-soluble, polymers, either anionic or non-ionic, can cause problems in the present process, it is generally desirable where bound charges at the higher levels are employed (a) to use latexes for which special precautions are taken in their preparation to minimize water-soluble polymer formation or (b) to add materials to the formulation which will insolubilize the water-soluble polymers or (c) to remove some or all of such water-soluble polymers.

Latexes of any conveniently obtainable particle size are useful in the practice of this invention but average particle diameters of from about 1000 to about 2600 angstroms are preferred—especially from about 1200 to about 1800 angstroms. Since the latex is diluted during the process, the solids content of a latex as supplied is not critical.

In the preparation of many of the latexes of different compositions useful in the invention, it is advantageous to use a chain transfer agent of known kinds such as, but not restricted to, the various long chain mercaptans, bromoform, and carbon tetrachloride.

The fillers which are used in the practice of this invention are finely-divided, essentially water-insoluble, inorganic materials. Such materials include, for example, titanium dioxide, amorphous silica, zinc oxide, barium sulfate, calcium carbonate, calcium sulfate, aluminum silicate, clay, magnesium silicate, diatomaceous earth, aluminum trihydrate, magnesium carbonate, partially calcined dolomitic limestone, magnesium hydroxide and mixtures of two or more of such materials. Magnesium hydroxide runs particularly well on common, available paper-making equipment to form a product having good properties, contributes to flame resistance and to resistance to microbiological attack and is preferred. However, calcium carbonate is sometimes preferred, especially in uses where the economic factors are particularly important, because it is readily available, provides good structure, runs well in the process and the impure grades, such as ground limestone, can be used. The particle size of the fillers is such that the preponderant proportion is below 50 microns in diameter. The average diameter is generally above about 0.1 micron and preferably is from about 0.1 to about 20 microns. For preferred embodiments the fillers should be free of asbestos contaminants.

In many embodiments of the process of this invention, a flocculating agent or destabilizing agent (sometimes also called a deposition aid) is highly advantageous. Such flocculating agents are water-dispersible, preferably water-soluble, ionic compounds or polymers, i.e., compounds or polymers having a positive or a negative charge. For the process, ordinarily a flocculating agent is chosen which has a charge opposite in sign to the ionic stabilization of the latex. If the latex has a negative charge, the flocculating agent will have a cationic charge and vice versa. However, when combinations of two or more flocculating agents are used, not all of them are necessarily opposite in charge to the initial charge of the latex.

Representative flocculants are cationic starch; water-soluble, inorganic salts such as alum, aluminum sulfate, calcium chloride and magnesium chloride; an ionic latex having a charge opposite in sign (+ or −) to that of the binder latex, e.g., a cationic latex or an anionic latex; water-soluble, ionic, synthetic, organic polymers such as polyethylenimine and various ionic polyacrylamides such as carboxyl-containing polyacrylamides; copolymers of acrylamide with dimethylaminoethyl methacrylate or diallyldimethyl ammonium chloride; polyacrylamides modified other than by copolymerization to have ionic groups; and combinations of two or more of the above, added simultaneously or in sequence. Quaternized polyacrylamide derivatives are especially advantageous when the latex which is used is anionic. Polymeric flocculants are preferred because they are more efficient, tend to produce less water-sensitive products and provide better shear stability of the furnish.

The preferred process for making the products of this invention is particularly adaptable to be carried out on handsheet-forming apparatus or common, continuous paper-making equipment such as a Fourdrinier machine, a cylinder machine, suction machines such as a Rotaformer, or on millboard equipment. Suitable also for use in the practice of this invention are other well-known modifications of such equipment, for example, a Fourdrinier machine with secondary headboxes or multicylinder machines in which, if desired, different furnishes can be used in the different cylinders to vary the composition and the properties of one or more of the several plies which can comprise a finished board. For further details, reference is made to the general summary of paper and paper making as found in Kirk-Othmer, *Encyclopedia of Chemical Technology,* Interscience Publishers, Inc., NY 14 (1967) pages 494–510, with the sheet forming aspect and appropriate equipment therefor being described on pages 505–508.

The preferred process requires the following steps:

(I) providing an aqueous dispersion of from about 1 percent to about 30 percent, preferably from about 5 percent to about 15 percent, of a water-dispersible, but water-insoluble fiber;

(II) mixing therewith (A) from about 60 percent to about 95 percent, preferably from about 70 percent to about 90 percent, of a finely-divided, substantially water-insoluble, non-fibrous, inorganic filler and (B) from about 2 percent to about 30 percent, preferably from about 5 percent to about 15 percent, of a binder containing a film-forming, water-insoluble, organic polymer in the form of an ionically stabilized latex;

(III) colloidally destabilizing the resulting mixture to form a fibrous agglomerate in aqueous suspension;

(IV) distributing and draining the aqueous suspension on a porous substrate such as a wire to form a wet web; and (V) drying the web.

The foregoing percentages are on a weight basis calculated on the total dry weight.

In the practice of this invention, the fibrous material is subjected to mechanical action in the presence of water in a manner variously described in the paper-making art as pulping, beating, or refining. Cellulosic fibers for this invention ordinarily are refined to a Canadian Standard Freeness (CSF) at 0.3 percent consistency of from about 300 milliliters to about 700 milliliters, preferably from about 400 milliliters to about 600 milliliters. Synthetic fibers are similarly mechanically treated but unless specially treated do not fibrillate to give the same degree of dispersion as is obtained with cellulosic pulps so that the Canadian Standard Freeness test is not particularly adapted to such materials. The synthetic fibers generally have a fiber length up to about $\frac{3}{8}$ inch, preferably from about $\frac{1}{8}$ inch to about $\frac{1}{4}$ inch.

The consistency (percentage by weight of dry fibrous material) of the stock thus obtained ordinarily is from about 0.1 percent to about 6 percent, preferably from about 0.5 percent to about 3 percent.

In the mixing of the fiber with other components of the sheet, additional water is included to reduce the consistency of the resulting furnish to a value ordinarily within the range of from about 0.1 percent to about 6 percent, preferably from about 1 percent to about 5 percent. Part of the water of dilution advantageously is white water, or process water, recycled from later steps in the sheet-making process. Alternatively or additionally, some of the process water can be used in the step of refining the fiber. Ordinarily the filler, the dilution water and the latex, generally prediluted to a lower solids content than at which it was manufactured, are added (usually but not necessarily in that order) to the fiber dispersion with agitation. At least some of the required colloidal destabilization can occur simultaneously with the mixing of the fiber, filler and latex either through interaction of the required components or through the concurrent addition of other optional wet-end additives such as those mentioned below. The mechanical shear caused by mixing and by transfer of the materials through the equipment used can cause, or assist in, the destabilization. However, the combination of the mixing and the destabilization steps produce a fibrous agglomerate in aqueous suspension, which at a concentration of 100 grams of solids in 13,500 milliliters of the aqueous suspension, should drain in a time of from about 4 seconds to about 120 seconds, especially from about 15 seconds to about 60 seconds and preferably from about 30 seconds to about 45 seconds in a 10-inch by 12-inch Williams Standard Sheet Mould, having a 2-inch outlet and a 30-inch water leg and fitted with a standard 100-mesh, stainless steel screen (wire size, 0.0045 inch) to provide in one pass at least 85 percent retention of solids which contain at least 60 percent by weight of filler. Additionally, in the preferred embodiments, the drainage water is substantially clear. An effective and preferred method of carrying out (or completing the carrying out) of the destabilization is the mixing with the other components a flocculating agent, i.e., a water-dispersible or water-soluble, ionic compound having a charge opposite in sign (+ or −) to that of the ionic stabilization in a sufficient amount, such an amount generally being less than about 1 percent, based on the total dry weight of the components. When used, a flocculant is added so that the destabilization can take place before the distributing and draining step. With continuous sheet-making apparatus such as the Fourdrinier paper machine, the flocculant is added at the stock chest or at such a point in the stock transfer portion of the apparatus that there is sufficient time for the desired action to take place yet not so much that the resulting flocculated stock is subjected to undue shear. After distributing and draining the resulting aqueous dispersion, the wet web obtained thereby optionally is wet-pressed and then dried with equipment conventionally used in paper-making.

The temperature of the proces through the step of forming the wet web usually is in the range of from about 40° F. (4.4° C.) to about 130° F. (54° C.) although temperatures outside those ranges can be used provided that they are above the freezing point of the aqueous dispersion and are below the temperature at which the latex polymer being used would soften unduly. Sometimes temperatures above ambient conditions promote faster drainage.

Also useful in the practice of this invention are small amounts of various other wet end additives of the types commonly used in paper-making. Such materials include antioxidants, various hydrocarbon and natural waxes, particularly in the form of anionic or cationic emulsions; cellulose derivatives such as carboxymethyl cellulose and hydroxyethyl cellulose; water-soluble organic dyestuffs, water-insoluble but water-dispersible coloring pigments such as carbon black, vat colors and sulfur colors; starch, natural gums such as guar gum and locust bean gum, particularly their anionic and cationic derivatives; non-ionic acrylamide polymers; strength improving resins such as melamine-formaldehyde resins, urea-formaldehyde resins and curing agents of various types such as the sulfur-containing vulcanizing agents and accessory compounds. Further quantities and/or kinds of anionic or cationic surfactants may also be added in small amounts at various points in the process if desired. Non-ionic surfactants should be used sparingly, if at all.

Optionally, either internal or external sizing can be employed together with the required features of this invention.

The densities of the products obtained from the above-described process cover a wide range, such as from about 30 pounds per cubic foot to about 150 pounds per cubic foot. Since the filler constitutes such a high proportion of the weight of the products, the identity of the filler selected for a particular product has considerable effect on the density and other properties of the product.

The thickness of the sheet which is produced can vary from about 3 mils to about 125 mils, the preferred value depending somewhat upon the proposed use. However, the thickness generally is from about 15 mils to about 65 mils.

The method of this invention results in production of water-laid, self-supporting sheets at high filler loading with a high proportion of the filler which is added being retained in the sheets. As commonly used in the art, the term "water-laid sheet" refers to a sheet which is deposited from a dilute aqueous suspension, usually having a solids content of four percent or less. While the filler constitutes the major proportion of the sheet, the latex and fiber are also retained in the sheet in high proportions. Retention in the sheet of all of the solids used in the process generally is greater than 85 percent by weight and in the preferred embodiments is greater than 95 percent.

The process and product of this invention has many advantages. In comparison with paper sheets of the prior art, there is less moisture in the sheet when it comes off the wet end of the machine. Hence, with the same basis weight of the sheet, less energy is required to dry the sheet and the machine can be run faster or a thicker sheet can be dried. The new process can be carried out using presently designed and available equipment of the kind commonly owned by paper manufacturers. Readily available raw materials are used. A large proportion of the raw materials is inexpensive filler and the total cost is low. The density can be altered simply by the choice of filler. The preferred embodiments also are asbestos-free.

The following examples illustrate ways in which the present invention may be carried out, but should not be construed as limiting the invention. All parts and percentages are by weight unless otherwise expressly indicated. Components identified by letter designations, e.g., Latex A, are described in Tables A, B, C and D.

TABLE A

| Identification | Fillers Description |
|---|---|
| A | Magnesium hydroxide; particle size, 5-10 microns, as an aqueous slurry at 58 percent solids. |
| B | Calcium carbonate; No. 9 whiting; average particle size, 15 microns. |
| C | Zinc oxide; particle size less than 1 percent retained on Tyler 325-mesh screen. |
| D | Titanium dioxide; particle size, less than 0.2 percent retained on Tyler 325-mesh screen. |
| E | Blend of 50 percent of Filler A and 50 percent of Filler N. |
| F | Blend of 80 percent of Filler A and 20 percent of Filler B. |
| G | Blend of 60 percent of Filler A and 40 percent of Filler B. |
| H | Barium sulfate; average particle size, 2.5 microns. |
| J | Talc, average particle size, 2.7 microns. |
| K | H. T. Clay, average particle size; 0.8 microns. |
| L | Alumina trihydrate; particle size; 75 percent through 325-mesh Tyler screen. |
| M | Magnesium carbonate; particle size; 90 percent through 200-mesh Tyler screen. |
| N | Expanded perlite; particle size, 1-16 percent retained on 325-mesh Tyler screen. |
| O | Magnesium hydroxide; particle size, 5-10 microns, as a powder. |
| P | Water-washed, paper filler grade clay, average particle diameter; 3 microns. |
| Q | Talc, average particle size 9 microns. |

TABLE B

| Identification | Latexes Description |
|---|---|
| A | A blend of 65 parts (solids basis) of a latex of a copolymer of 56 percent of styrene and 44 percent of butadiene prepared with 1 percent of bromoform chain transfer agent and containing 0.5 percent of the disodium salt of dodecyldiphenyl ether disulfonic acid and 4 percent of a modified rosin soap, the percentages being based on the copolymer weight, with 35 parts of Latex G and an additional 0.2 percent, based on the total polymer weight in the blend of tridecyl sodium sulfate, the blend having a bound charge of between 0.02 and 0.06 milliequivalent per gram of polymer. |
| B | A blend of 75 parts (solids basis) of a latex of a copolymer of 50 percent of styrene and 50 percent of butadiene prepared with 1 percent of bromoform chain transfer agent and containing 0.5 percent of the disodium salt of dodecyldiphenyl ether disulfonic acid and 4 percent of a modified rosin soap, the percentages being based on the copolymer weight, with 25 parts (solids basis) of Latex G, the blend having a bound charge of between 0.02 and 0.06 milliequivalent per gram of copolymer. |
| C | A latex of a copolymer of 41 percent of styrene, 55 percent of butadiene, 3 percent of itaconic acid and 1 percent of acrylic acid prepared with 1.75 percent of bromoform chain transfer agent and containing 0.5 percent of the disodium salt of dodecyldiphenyl ether disulfonic acid, the percentages being based on the weight of polymer in the latex. The bound charge is 0.144 milliequivalent of weak acid (carboxyl) and 0.058 milliequivalent of strong acid (sulfate) per gram of copolymer. |
| D | A blend of 80 parts of Latex C with 20 parts of Latex G having a bound charge of between 0.15 and 0.2 milliequivalent per gram of polymer. |
| E | A blend of 80 parts of Latex C and 20 parts of a latex of a copolymer of 80 percent of styrene and 20 percent of butadiene containing 0.1 percent of the disodium salt of dodecyldiphenyl ether disulfonic acid, the blend having a bound charge of between 0.15 and 0.2 milliequivalent per gram of copolymer. |
| F | A blend like Latex A except that the amount of Latex G in the blend is 30 percent rather than 35 percent, the blend having a bound charge of between 0.02 and 0.06 milliequivalent per gram of polymer. |
| G | A latex of a copolymer of 81 percent of styrene, 17 percent of butadiene and 2 percent of acrylic acid prepared with 2 percent of carbon tetrachloride chain transfer agent and containing 0.2 percent of tridecyl sodium sulfate, the percentages being based on the weight of copolymer in the latex. The bound charge of the latex is 0.065 milliequivalent per gram of copolymer. |
| H | A blend of 70 parts (solids basis) of a latex of a copolymer of 50 percent of styrene and 50 percent of butadiene prepared with 1 percent of bromoform chain transfer agent and containing 0.5 percent of the disodium salt of dodecyldiphenyl ether disulfonic acid and 4 percent of a modified rosin soap, the percentages being based on the copolymer weight, with 30 parts (solids basis) of Latex C, the blend having a bound charge of between 0.07 and 0.1 milliequivalent per gram of copolymer. |
| J | A polychloroprene latex stabilized with a rosin acid soap having essentially no measurable bound charge. |
| K | A Latex of a copolymer of 95.5 percent ethyl acrylate, 2 percent of acrylamide and 2.5 percent of N-methylolacrylamide containing 0.5 percent of sodium lauryl sulfate, having an average particle diameter of 900 angstroms, all percentages being based on the copolymer weight and having a bound charge less than 0.03 milliequivalent per gram of copolymer. |
| L | A latex of a copolymer of 65 percent |

TABLE B-continued

| Identification | Latexes Description |
|---|---|
| | of styrene and 35 percent of butadiene prepared with 0.2 percent of dodecanethiol chain transfer agent, stabilized by 4 percent dodecylbenzyltrimethylammonium chloride surfactant, having an average particle diameter of 750 angstroms, all percentages being by weight based on the copolymer weight and having a bound charge less than 0.02 milliequivalent per gram of copolymer. |
| M | A latex of a copolymer of 90 percent of vinylidene chloride, 5 percent of butyl acrylate and 5 percent of acrylonitrile which is obtained by the concurrent polymerization of the monomers with 1.4 percent of sulfoethyl methacrylate, having an average particle diameter of 1200 angstroms, all percentages being based on the copolymer weight and having a bound charge of between 0.03 and 0.04 milliequivalent per gram of copolymer. |
| N | A blend of 70 parts (solids basis) of a latex of a copolymer of 49 percent of styrene, 50 percent of butadiene and 1 percent of itaconic acid prepared in the presence of 6 percent of carbon tetrachloride and containing 0.75 percent of the disodium salt of dodecyldiphenyl ether disulfonic acid with 30 parts (solids basis) of Latex G. The blend has a bound charge of 0.116 milliequivalent of weak acid (carboxyl) and 0.031 milliequivalent of strong acid (sulfate) per gram of polymer in the blend, all percentages being based on the respective copolymer weight. |
| O | A latex of a copolymer of 48 percent of styrene, 50 percent of butyl acrylate and 2 percent of acrylic acid containing 0.5 percent of the disodium salt of dodecyldiphenyl ether disulfonic acid, the percentages being based on the copolymer weight. The latex has a bound charge of 0.071 milliequivalent of acid (carboxyl) per gram of copolymer. |
| P | A latex like "O" except the copolymer composition is 46 percent of styrene, 50 percent of butyl acrylate, and 4 percent of acrylic acid and the bound charge is 0.092 milliequivalent (carboxyl) per gram of copolymer. |
| Q | A latex of a copolymer of 69 percent of vinylidene chloride, 4.9 percent of butyl acrylate, 24.7 percent of acrylonitrile and 1.4 percent of 2-sulfoethyl methacrylate. The bound charge is 0.039 milliequivalent per gram of copolymer. |
| R | A latex prepared by the emulsion copolymerization of 35 percent of styrene, 55 percent of butadiene and 10 percent of acrylic acid in the presence of 8 percent of carbon tetrachloride chain transfer agent, 0.75 percent of ammonium persulfate catalyst and 0.5 part of the disodium salt of dodecyldiphenyl ether disulfonic acid, all percentages being based on the total monomer weight. The bound charge is 0.268 milliequivalent of weak acid (carboxyl) and 0.091 milliequivalent of strong acid (sulfate) per gram of copolymer. The pH of the latex is 3.4. |

TABLE C

| Identification | Fibers Description |
|---|---|
| A | Bleached softwood kraft. |
| B | Bleached hardwood kraft. |
| C | Blend of 50 percent of Fiber A and 50 percent of Fiber B. |
| D | Unbleached southern pine kraft. |
| E | Unbleached northern softwood kraft. |
| F | Unbleached sulfite softwood. |
| G | SWP-fibrillated polyethylene; E-400 fiber length, 0.9 mm. |
| H | SWP-fibrillated polyethylene; R-830, fiber length, 2.0 mm. |
| I | SWP-fibrillated polyethylene; R-990, fiber length, 2.5 mm. |
| J | Blend of 50 percent of Fiber I and 50 percent of Fiber D. |
| K | Blend of 25 percent of Fiber I and 75 percent of Fiber D. |
| L | Blend of 50 percent of Fiber G and 50 percent of Fiber D. |
| M | Polyester (polyethylene terephthalate); denier per filament, 6.0; fiber length, 0.135 in. |
| N | Nylon 66; denier per filament, 3.0; fiber length, 0.25 in. |
| O | Rayon; denier per filament, 5.5; fiber length, 0.135 in. |
| P | Mineral wool. |
| Q | Blend of 50 percent of Fiber D and 50 percent of Fiber P. |
| R | Blend of 75 percent of Fiber E, 12.5 percent of polyethylene terephthalate fiber, 3 denier per filament; ¼ inch length and 12.5 percent of starch-sized glass fibers, ¼ inch length and 6 micron diameter. |

TABLE D

| Indentification | Flocculants Description |
|---|---|
| A | A copolymer of acrylamide and dimethylaminoethyl methacrylate, quaternized with dimethylsulfate (Betz 1260) having an Ostwald viscosity of 17 centipoises as a 0.5 percent aqueous solution containing 3 percent of sodium chloride at 25° C. |
| B | A Mannich reaction product of polyacrylamide, formaldehyde and dimethylamine which is quaternized with methyl chloride, the resulting quaternized product being of the kind described in U.S. Pat. No. 4,010,131, Phillips et al., March 1, 1977, the reaction product having an Ostwald viscosity of 30 centipoises as a 0.5 percent aqueous solution containing 3 percent sodium chloride at 25° C. |
| C | Alum. |
| D | A high molecular weight polyacrylamide about 5 percent hydrolyzed and having a viscosity of 23 centipoises when measured at 25° C. as a 0.5 percent aqueous solution. |
| E | A terpolymer of acrylamide, dimethyldiallylammonium chloride, and diethyldiallylammonium chloride having an |

TABLE D-continued

| Indentification | Flocculants Description |
|---|---|
| | Ostwald viscosity of 3.7 centipoises as a 0.5 percent aqueous solution containing 3 percent sodium chloride at 25° C. |

In the examples where handsheets are made, a specially-developed standard procedure is used with such modifications as are shown in specific examples. In the standard procedure, the indicated fiber (if cellulosic) is pulped to a Canadian Standard Freeness (CSF) of 500 milliliters and a consistency of about 1.2 percent by weight. The synthetic fibers are dispersed in water with a TAPPI disintegrator (600 counts) but a Canadian Standard Freeness measurement is not made. With a sufficient quantity of the resulting aqueous dispersion to provide 5 grams of the fiber, dry basis, is mixed an additional precalculated amount of water to give a final volume of 2000 milliliters. Stirring is continued while 80 grams of the indicated filler is added as a powder except where shown as an aqueous slurry, followed by 15 grams, solids basis, of the indicated latex. The resulting mixture is mechanically sheared for 15 seconds in a Jabsco centrifugal pump followed by agitation with a laboratory stirrer having two 3-bladed propellers on one shaft operated at 900 rpm while a 0.1 percent solution of the indicated flocculant is added slowly until the water phase is essentially clear. A sufficient amount (about 62 ml) of the resulting furnish to provide 3 grams of solids is diluted to 1000 milliliters with water and the Canadian Standard Freeness is measured according to TAPPI Standard T 227-M-58. The freeness sample is returned to the furnish which is then diluted to 13,500 milliliters and a sheet is formed in a 10-inch by 12-inch Williams Standard Sheet Mould and the drainage time on a 100-mesh screen is recorded. The resulting wet sheet is couched from the wire in a press at approximately 10 pounds per square inch using two blotters to absorb water from the sheet. The sheets are stacked alternately with blotters and wet pressed at 500 pounds per square inch. The partially dried sheets are then weighed and dried on a sheet dryer at a platen temperature of 240° to 250° F. (116° to 121° C.), alternating sides of the sheet against the platen at 0.5 to 1-minute intervals. The resulting dried sheets are weighed to determine the total solids which are retained in the sheet. Since sufficient materials are used to make a 100-gram sheet on complete retention, the dry weight also represents the percent retention.

EXAMPLES 1–14

Handsheets are prepared from the designated latex, unbleached southern pine kraft and the designated fillers using Flocculant A by the standard procedure described above except as indicated. The data for the preparation of the sheets are shown in Table I. The properties of the sheets are shown in Table II.

TABLE I

SHEET PREPARATION DIFFERENT FILLERS

| Example No. | Latex | Filler Kind | Flocculant Amount ml(a) | Furnish CSF ml | Drain Time sec |
|---|---|---|---|---|---|
| 1 | A | A | 40 | 630 | 79 |
| 2 | B | E | 245 | 650 | 30 |

TABLE I-continued

SHEET PREPARATION DIFFERENT FILLERS

| Example No. | Latex | Filler Kind | Flocculant Amount ml(a) | Furnish CSF ml | Drain Time sec |
|---|---|---|---|---|---|
| 3 | A | A | 80 | 710 | 42 |
| 4 | A | C | 130 | 800 | 23 |
| 5 | A | D | 60 | 600 | 100 |
| 6 | B | F | 125 | 780 | 30 |
| 7 | B | G | 220 | 800 | 18 |
| 8 | B | B | 370 | 840 | 15 |
| 9 | F | I (b) | 190 | 850 | 60 |
| 10 | B | H | 160 | 785 | 9 |
| 11 | B | J | 180 | 730 | 7 |
| 12 | B | K | 300 | 790 | 7 |
| 13 | B | L | 360 | 850 | 13 |
| 14 | H | M | 240 | 700 | 20 |

(a)0.1 aqueous solution.
(b)75 parts of filler, 10 parts of fiber.

TABLE II

SHEET PROPERTIES DIFFERENT FILLERS

| Ex. No. | Wt. Dry g. | Thickness mils | Density Lb/Ft$^3$ | Tensile(a) R.T. psi | Tensile(a) Hot(b) psi | Taber Stiffness(a) Reg | Taber Stiffness(a) DOP | Taber Stiffness(a) $H_2O$ |
|---|---|---|---|---|---|---|---|---|
| 1 | 95.5 | 56 | | 740 | 240 | 390 | 30 | |
| 2 | 95.9 | 73 | 47 | 400(d) | 100(d) | 22(d) | 5(d) | 2(d) |
| 3 | 88.1 | 52 | | 550 | 150(d) | 360 | 23 | |
| 4 | 98.3 | 42 | | 880 | 290 | 260 | 50 | |
| 5 | 93.4 | 36 | | 1270 | 430 | 280 | 70 | |
| 6 | 91.0 | 45 | 72.2 | 820 | 260 | 106(c) | 18(d) | 35(d) |
| 7 | 88.3 | 42 | 75.0 | 800 | 260 | 100(c) | 18(d) | 25(d) |
| 8 | 88.7 | 38 | 84.2 | 750 | 170 | 94(c) | 20(d) | 16(d) |
| 9 | 96.0 | 82 | | 260 | | | | |
| 10 | 96.5 | 29 | 116 | 1170(d) | 380(d) | 150(d) | 30(d) | 21(d) |
| 11 | 99.3 | 48 | 72 | 590(d) | 200(d) | 87(d) | 17(d) | 12(d) |
| 12 | 99.0 | 45 | 78 | 530(d) | 260(d) | 98(d) | 3(d) | 12(d) |
| 13 | 99.0 | 46 | 63 | 360(d) | 90(d) | 29(d) | 4(d) | 4(d) |
| 14 | 92.5 | 36 | 90 | 410(d) | 70(d) | | | |

(a)average of 3 samples, unless indicated otherwise.
(b)at 350° F. (177° C.)
(c)average of 4 samples.
(d)average of 2 samples.

EXAMPLES 15–42

Handsheets are prepared from the designated latex, the designated kind of fiber pulped to the designated Canadian Standard Freeness (CSF), the designated filler and the designated flocculant by the standard procedure described above except as indicated. Sheet preparation data are shown in Table III and the sheet properties in Table IV.

TABLE III

SHEET PREPARATION DIFFERENT FIBERS

| Ex. No. | Latex Kind | Filler Kind | Fiber Kind | Fiber CSF ml | Flocculant Kind | Flocculant Amount ml | Furnish CSF ml | Drain Time sec |
|---|---|---|---|---|---|---|---|---|
| 15 | C | A | A | 600 | B | 330 | 560 | 113 |
| 16 | C | A | A | 500 | B | 340 | 580 | 76 |
| 17 | C | A | A | 400 | B | 330 | 590 | 87 |
| 18 | D | A | A | 600 | B | 280 | 550 | 62 |
| 19 | D | A | A | 500 | B | 280 | 580 | 62 |
| 20 | D | A | A | 400 | B | 300 | 560 | 71 |
| 21 | D | A | B | 600 | B | 310 | 660 | 55 |
| 22 | D | A | B | 500 | B | 300 | 650 | 57 |
| 23 | D | A | B | 400 | B | 315 | 620 | 47 |
| 24 | D | A | C | 500 | B | 330 | 635 | 64 |
| 25 | D | A | D | 500 | B | 325 | 700 | 55 |
| 26 | D | A | E | 500 | B | 315 | 730 | 33 |

TABLE III-continued

| SHEET PREPARATION DIFFERENT FIBERS | | | | | | | | |
|---|---|---|---|---|---|---|---|---|
| | | Filler | Fiber | | Flocculant | | Furnish | Drain |
| Ex. No. | Latex Kind | Kind | Kind | CSF ml | Kind | Amount ml | CSF ml | Time sec |
| 27 | D | A | F | 500 | B | 325 | 700 | 51 |
| 28 | C | F | D | 500 | A | 440 | 610 | 66 |
| 29 | C | F | G | — | A | 420 | 600 | 43 |
| 30 | C | F | H | — | A | 440 | 550 | 37 |
| 31 | C | F | I | — | A | 340 | 620 | 62 |
| 32 | C | F | J | — | A | 380 | 700 | 34 |
| 33 | C | F | K | — | A | 380 | 610 | 39 |
| 34 | C | H | L | — | A | 800 | — | 33 |
| 35 | F | A | M | — | A | 140 | 740 | 30 |
| 36 | F | A* | M* | — | A | 170 | 800 | 22 |
| 37 | F | A | N | — | A | 160 | 750 | 40 |
| 38 | F | A* | N* | — | A | 170 | 780 | 23 |
| 39 | F | A | O | — | A | 160 | 700 | 41 |
| 40 | F | A | P | 500 | A | 110 | 700 | 91 |
| 41 | A | A | P* | — | A | 70 | 720 | 27 |
| 42 | A | A | Q* | — | A | 45 | 770 | 18 |

*10 parts of fiber, 75 parts of filler.

TABLE IV

| SHEET PROPERTIES DIFFERENT FIBERS | | | | | | |
|---|---|---|---|---|---|---|
| | Wt. | | | Tensile | | Tabor |
| Ex. No. | Dry g. | Thickness mils | Density Lb/Ft$^3$ | R.T.(a) psi | Hot(b) psi | Stiffness Reg |
| 15 | 90.1 | 45 | 74.2 | 630 | | 51 |
| 16 | 94.3 | 48 | 71.5 | 680 | | 50 |
| 17 | 94.5 | 47 | 72.3 | 670 | | 57 |
| 18 | 92.1 | 49 | 67.9 | 800 | | 69 |
| 19 | 94.1 | 47 | 71.5 | 810 | | 74 |
| 20 | 91.8 | 46 | 71.4 | 800 | | 75 |
| 21 | 96.0 | 46 | 75.2 | 780 | | 73 |
| 22 | 96.1 | 47 | 73.1 | 880 | | 82 |
| 23 | 95.2 | 47 | 72.2 | 850 | | 83 |
| 24 | 95.1 | 47 | 72.0 | 840 | | 89 |
| 25 | 99.1 | 55 | 65.9 | 730 | | 62 |
| 26 | 97.8 | 50 | 69.7 | 1130 | | 82 |
| 27 | 96.8 | 51 | 67.8 | 930 | | 82 |
| 28 | 88.6 | 46 | 81.5 | 900(b) | 570 | |
| 29 | 91.5 | 49 | 79.0 | 280(b) | 120 | |
| 30 | 91.0 | 46 | 78.3 | 290(b) | 100 | |
| 31 | 88.3 | 51 | 73.2 | 230(c) | 110 | |
| 32 | 94.9 | 49 | 81.9 | 470(b) | 240 | |
| 33 | 96.3 | 50 | 81.5 | 490(b) | 340 | |
| 34 | 98.3 | 28 | 135.2 | 500(b) | 270 | |
| 35 | 90.9 | 49 | | 930 | 140 | 84 |
| 36 | 96.5 | 53 | | 1290 | 210 | 110 |
| 37 | 96.6 | 54 | | 410 | 110 | 72 |
| 38 | 95.5 | 58 | | 560 | 160 | 72 |
| 39 | 94.9 | 52 | | 265 | 50 | 58 |
| 40 | 97.8 | 52 | | 1130 | 330 | 108 |
| 41 | 91.0 | 54 | 59.1 | 390 | 70 | 25 |
| 42 | 96.1 | 58 | 59.6 | 670 | 210 | 31 |

(a)average of 3 samples, unless otherwise indicated.
(b)average of 2 samples, unless otherwise indicated.
(c)one sample.

EXAMPLES 43–46

Handsheets are prepared by the standard procedure described above wherein the fiber is Fiber D, and the filler, latex and flocculant are the kinds specified in Table V. Sheet properties are shown in Table VI.

TABLE V

| SHEET PREPARATION | | | | | | |
|---|---|---|---|---|---|---|
| | | | Flocculant | | | Drain |
| Example No. | Latex Kind | Filler Kind | Kind | Amount ml | Furnish CSF | Time sec |
| 43 | J | B | A | 60 | 820 | 15 |

TABLE V-continued

| SHEET PREPARATION | | | | | | |
|---|---|---|---|---|---|---|
| | | | Flocculant | | | Drain |
| Example No. | Latex Kind | Filler Kind | Kind | Amount ml | Furnish CSF | Time sec |
| 44 | K | A | B | 150 | 800 | 9 |
| 45 | L | A | D | 500 | 850 | 5 |
| 46 | M | A | A | 70 | 450 | 46 |

TABLE VI

| SHEET PROPERTIES | | | | | |
|---|---|---|---|---|---|
| | Wt. | | | Tensile | |
| Example No. | Dry g. | Thickness mils | Density Lb/Ft$^3$ | R.T. psi | Hot psi |
| 43 | 85.2 | | | | |
| 44 | 92.5 | 48 | | 320 | 142 |
| 45 | 89.0 | 50 | 65.3 | 13 | 4 |
| 46 | 87.8 | 50 | | 580 | 270 |

EXAMPLES 47–49

Handsheets are prepared by the standard procedure described above wherein the fiber is unbleached softwood kraft, the latex is Latex B, the filler is Filler A, and the flocculant is as specified. In addition of the flocculant, the indicated amount of alum was added first and stirred for one minute, then a sufficient amount of the other flocculant to complete flocculation was added. Data for preparation of the handsheets are shown in Table VII. Properties of the sheets are shown in Table VIII.

TABLE VII

| SHEET PREPARATION | | | | | |
|---|---|---|---|---|---|
| | Flocculant | | | Furnish | Drain |
| Example No. | C(a) ml | (b) ml | B(b) ml | CSF ml | Time sec |
| 47 | 12 | 0 | 0 | 600 | 50 |
| 48 | 6 | 54 | 0 | 700 | 29 |
| 49 | 6 | 0 | 80 | 650 | 24 |

(a)as 5% aqueous solution.
(b)as 0.1% aqueous solution.

TABLE VIII

| SHEET PROPERTIES | | | | | | | |
|---|---|---|---|---|---|---|---|
| | | | | | Hot | Taber Stiffness | |
| Ex. No. | Wt. g. | Thickness mils | Density Lb/Ft$^3$ | Tensile psi | Tensile psi | Reg | DOP |
| 47 | 95.8 | 50 | 68.0 | 462 | 199 | 71 | 13 |
| 48 | 102.2 | 53 | 70.0 | 462 | 152 | 69 | 10 |
| 49 | 100.2 | 51 | 70.6 | 658 | 228 | 99 | 15 |

EXAMPLES 50–53

Handsheets are prepared by the standard procedure described above wherein the fiber, latex, and flocculant are as shown and the filler is Filler A in the amount as shown. Data for the sheet preparation are shown in Table IX. Samples of the sheets are placed in a tropical chamber maintained at 100 percent relative humidity and 90° F. (32.2° C.) which has previously been inoculated with organisms including Aspergillus niger, Trichoderma viride, Aureobasidium pullulans, Chaetomium globosum and unidentified species of Penicillium. At the end of 21 days and 49 days, the samples are checked for visible evidence of microbiological attack and room temperature tensile loss values are measured on strips 3 inches long over a one-inch span of the samples. For comparison, handsheets are prepared from 85 parts of asbestos (Johns Manville, Paperbestos No. 5) and 15 parts of Latex C (Comparative Example A-1) and 85 parts of asbestos and 15 parts of Latex B (Comparative Example A-2). Test data are shown in Table X.

The visual rating is based on an arbitrary scale for visible evidence of microbiological attack as follows:

0=no attack
1=very slight attack
2=slight attack
3=moderate attack
4=heavy attack
5=very heavy attack The tensile tests are carried out, with the exception of the length of the test strip, in the manner described after all the examples. The tensile data recorded in Table X is the percent change in tensile between the test strips and control strips of the same kind which are prepared at the same time and are held for the same period outside the tropical chamber.

TABLE IX

SHEET PREPARATION FOR TROPICAL CHAMBER TESTS

| Example No. | Fiber Kind | Fiber Amount | Latex Kind | Filler Amount | Flocculant Kind | Flocculant Amount ml | Furnish CSF ml | Drain Time sec |
|---|---|---|---|---|---|---|---|---|
| 50 | D | 5 | B | 80 | B | 165(a) | 770 | 27 |
| 51 | A | 10 | B | 75 | A | 200(a) | 790 | 42 |
| 52 | A | 10 | B | 75 | C | 70(b) | 650 | 38 |
| 53 | A | 10 | C | 75 | B | 460(a) | 700 | 40 |
| A-1* | | | | | | | 650 | 35 |
| A-2* | | | | | | | 650 | 20 |

*Not examples of the invention.
(a) = as 0.1% aqueous solution.
(b) = as 5% aqueous solution.

TABLE X

SHEET TESTS TROPICAL CHAMBER

| Example No. | Weight g. | Visual Rating Days 21 | Visual Rating Days 49 | Percent Change in Tensile Days 21 | Percent Change in Tensile Days 49 |
|---|---|---|---|---|---|
| 50 | 98.2 | 1 | 2 | −7.8 | 0 |
| 51 | 96.9 | 1 | 1 | +.9 | +5.5 |
| 52 | 95.8 | 1 | 1 | +3.9 | +2.1 |
| 53 | 96.8 | 1 | 2 | +4.5 | +2.0 |
| A-1* | — | 1 | 1 | −3.1 | +12.6 |
| A-1* | — | 1 | 1 | +2.9 | −0.3 |

*Not examples of the invention.

EXAMPLES 54–60

Handsheets are prepared by the standard procedure described above except that different ratios of fiber, latex and filler are used. The fiber is unbleached softwood kraft, the latex is Latex B, the filler is Filler B and the flocculant is Flocculant A. Data are shown in Table XI.

TABLE XI

DIFFERENT RATIOS OF COMPONENTS

| Example No. | Fiber g. | Latex g. | Filler g. | Flocculant ml. | Furnish CSF ml | Drain Time sec | Sheet Retention % | Sheet Density Lb/Ft³ | Sheet Tensile psi |
|---|---|---|---|---|---|---|---|---|---|
| 54 | 1.0 | 19.0 | 80.0 | 215 | 520 | 15 | 89 | 79 | 307 |
| 55 | 2.5 | 25.0 | 72.5 | 370 | 860 | 7 | 96 | 69 | 382 |
| 56 | 5.0 | 30.0 | 65.0 | 630 | 860 | 4 | 88 | 80 | 478 |
| 57 | 10.0 | 10.0 | 80.0 | 102 | 810 | 9 | 89 | 69 | 903 |
| 58 | 15.0 | 5.0 | 80.0 | 85 | 780 | 10 | 92 | 68 | 1026 |
| 59 | 25.0 | 10.0 | 65.0 | 205 | 830 | 12 | 90 | 69 | 2099 |
| 60 | 5.0 | 5.0 | 90.0 | 100 | 850 | 21 | 97 | 75 | 279 |

EXAMPLES 61–62

A handsheet (Example 61) is prepared from unbleached softwood kraft, Latex F, Filler O and Flocculant A by the standard procedure described above. Another handsheet (Example 62) is prepared in the same manner except that 0.25 part of a cationic polyamide-epichiorohydrin resin (Kymene 557) is added as a 0.132 percent aqueous solution to the aqueous fiber dispersion before mixing with the filler and latex. Data are shown in Table XII.

TABLE XII

| | Example 61 | Example 62 |
|---|---|---|
| Flocculant A, ml | 150 | 150 |
| Furnish CSF, ml | 755 | 600 |
| Drain time, sec | 50 | 110 |
| Sheet thickness, mils | 50 | 45 |
| Sheet weight, g (% retention) | 94.9 | 87.0 |
| Density, Lb/Ft³ | 68.3 | 68.3 |
| Tensile, psi | 800 | 940 |
| Tensile, hot (350° F.) (177° C.), psi | 300 | 320 |

EXAMPLES 63–64

Handsheets are prepared from Latex N, Fiber R, and the designated filler using Flocculant E in the indicated amount according to the standard procedure except that a wet-strength additive, which is a cationic polyamide-epichlorohydrin resin having 12.8 percent nitrogen, is added after the filler in the amount shown in Table XIII, and 1 percent total solids basis, of an anionic emulsified hydrocarbon wax is added after the latex. A summary of data is provided in Table XIII.

TABLE XIII

| | Example 63 | Example 64 |
|---|---|---|
| Filler P, % (solids basis) | 77 | — |
| Filler Q, % (solids basis) | — | 77 |
| Latex N, % (solids basis) | 15 | 15 |
| Fiber R, % (solids basis) | 8 | 8 |
| Flocculant E, Lb/Ton of solids | 2.6 | 1.2 |
| Wet-strength additive, Lb/Ton of solids | 8 | 11.4 |
| Drain time, sec | 50 | 54 |
| Density of sheet, Lb/Ft$^3$ | 75.5 | 74 |
| Tensile, R.T., psi | 2076 | 1738 |
| Tensile, hot, psi | 763 | 502 |
| Tensile, DOP, psi | 945 | 675 |
| Tensile, water, psi | 1138 | 1162 |
| Elongation, RT, % | 3.5 | 2.7 |
| Elongation, 350° F. (177° C.), % | 2.3 | 2.0 |
| Elongation, DOP, % | 3.3 | 2.3 |
| Elongation, water, % | 6.3 | 5.0 |
| *Water pickup, % | 8.9 | 5.5 |
| *Water swell, % (length) | 0.38 | 0.22 |

*Specimens were 6 inches (15 cm.) rather than 4 inches in length

The products from these Examples in view of their properties, especially dimensional stability in the presence of water, are particularly adapted for use in flooring compositions.

EXAMPLES 65–70

Using the standard procedure except that the step of mechanically shearing on a Jabsco centrifugal pump was omitted, handsheets are prepared from the designated latex, Fiber E and Filler Q using Flocculant E in the proportions shown in Table XIV for the latex, fiber and flocculant and the amount of filler is the difference between 100 percent and the total of latex and fiber, all on a dry solids basis. Also the amounts are chosen such as to provide handsheets theoretically weighing 75 grams rather than 100 grams and the dilution water of the furnish is reduced correspondingly. Data are shown in Table XIV.

TABLE XIV

| | Example No.* | | | | | |
|---|---|---|---|---|---|---|
| | 65 | 66 | 67 | 68 | 69 | 70 |
| Latex, Kind | O | O | P | P | Q | A |
| Amount, % (a) | 15 | 7.5 | 15 | 7.5 | 15 | 7.5 |
| Fiber E, Amount, % (a) | 6 | 10 | 6 | 10 | 6 | 10 |
| Flocculant E, Amount, Lb/ton (a) | 6.6 | 4.0 | 8.0 | 4.7 | 8.0 | 4.7 |
| Drain Time, sec. | 97 | 59 | 64 | 41 | 122 | 61 |
| Tensile, R.T., psi | 1948 | 1563 | 1869 | 2004 | 1713 | 1568 |

(a) = dry solids basis
* = The percent retention on all of these examples is greater than 92.

EXAMPLE 71 and COMPARATIVE EXAMPLE 71-C

With a portion of Latex R is blended 8 percent (based on the solids content of the latex) of carbon tetrachloride. The resulting product is centrifuged. The aqueous serum is removed and the remaining solids are washed with water. The resulting damp solids are redispersed in water by subjecting the solids and water to vigorous agitation for from 30 minutes to one hour. The resulting dispersion is Latex R-1 and has a pH of 3.8.

Except for using quantities theoretically sufficient to prepare a 30-gram sheet rather than a 100-gram sheet and correspondingly reducing the dilution water of the furnish, the standard process for preparing handsheets is used with each of Latex R and Latex R-1 in a proportion of 15 percent of the respective latex, 15 percent of Fiber E and 75 percent of Filler K (solids basis, calculated on the weight of latex, fiber and filler) using 127 milliliters of a 0.1 percent aqueous solution of Flocculant E. Damp handsheets are formed with each of Latex R-1 (Example 71) and Latex R (Comparative Example 71-C) with a drainage time of 20 seconds and 29 seconds, respectively. In Example 71 there is only a barely detectable amount of scum in preparation of the furnish with only slight sticking of the sheet to the wire when the damp handsheet is dried. During the addition of the flocculant, the progression of flocculation is easily observed. However, in comparative Example 71-C, a large amount of scum and froth appears in the preparation of the furnish. Such severe sticking of the dried handsheet to the wire and blotter occurs that a sheet cannot be separated from the wire.

The bound charge on Latex R and Latex R-1 is the same because the procedure to prepare Latex R-1 from Latex R would not alter the existing bound charge (from carboxyl groups). The significant difference is the removal from Latex R of water soluble components, e.g., surfactants and acrylic acid polymers or copolymers of sufficiently low molecular weight and high enough carboxyl content to be water soluble. These results are consistent with the view that too large amounts of water-soluble polymers, including surfactants and ionic polymers are deleterious in carrying out the present process.

EXAMPLES 72 and 73

An aqueous dispersion of fiber is prepared at about 4 percent consistency from bleached southern pine kraft and water in a Black Clawson Hydrapulper. The crude dispersion is pumped to a refiner chest and refined to a Canadian Standard Freeness of 500 milliliters by recirculation through a Sprout-Waldron Twin-Flow Refiner. Highly filled sheets for Examples 72 and 73 are prepared from portions of the fiber dispersion, a latex and a filler as identified and in the proportions shown in Table XV by use of a 31-inch Fourdrinier paper machine having a phosphor bronze, long crimp wire, four flat suction boxes between the breast roll and a suction couch roll, a first wet press, a reverse press, a multi-section dryer with a size press between sections and a 7-roll calendar stack. The fiber dispersion, filler water, and the latex diluted to 25 percent solids are added to a machine chest, in that order, with the amount of added water being calculated to provide 4 percent consistency. The resulting stock is transferred with the aid of a stock pump through a stock valve and then through a fan pump to the headbox. The flocculant shown in Table XV is added between the stock pump and the stock valve and some white water from the later stages of the process is returned to the system between the stock valve and the fan pump so that the consistency of the furnish in the headbox is as shown in Table XV. The furnish from the headbox is fed onto the wire moving at 20 feet per minute where white water drains to form a wet sheet from which additional water is removed by means of the four suction boxes before the sheet is removed from the wire at the suction couch roll. After the two press stages have reduced the water-content still further, the sheet is fed through the dryer and calendar stack. Data for the process and property data for the highly filled sheets thus formed are shown in Table XV.

TABLE XV

| | | Example 72 | Example 73 |
|---|---|---|---|
| Filler A, % (solids basis) | | 75 | 80 |
| Latex C, % (solids basis) | | 15 | — |
| Latex F, % (solids basis) | | — | 15 |
| Bleached softwood kraft, % (solids basis) | | 10 | 5 |
| Flocculant A, lb/ton of solids | | — | 1.4 |
| Flocculant B, lb/ton of solids | | 12 | — |
| Chest consistency, % | | 4.0 | 4.1 |
| Headbox consistency, % | | 3.31 | 1.22 |
| Headbox Canadian Standard Freeness, ml | | 603 | 668 |
| Machine Speed, fpm | | 20 | 20 |
| Wet Pressing, | 1st press, pli | 20 | 20 |
| | 2nd press, pli | 70 | 70 |
| Retention, % | | 99 | 102 |
| Caliper, mils | | 28.4 | 27.7 |
| Density, Lb/Ft$^3$ | | 58.5 | 56.5 |
| Tensile, | MD, psi | 734 | 460 |
| | CD, psi | 518 | 409 |
| Hot Tensile, | MD, psi | 428 | 190 |
| | CD, psi | 330 | 88 |
| DOP Tensile, | MD, psi | 542 | 135 |
| Elongation, | R.T., % | | |
| | MD | 3.1 | 2.0 |
| | CD | 7.9 | 3.8 |
| Elongation, | hot, % | | |
| | MD | 2.0 | 1.7 |
| | CD | 4.0 | 2.8 |
| Elongation, | DOP, MD, % | 2.3 | 1.7 |
| Stiffness, | MD | | |
| | Taber | 119 | 119 |
| | DOP | 81 | 29 |
| | Water | 20 | 29 |
| Stiffness, | CD | | |
| | Taber | 81 | 72 |
| | DOP | 46 | 12 |
| | Water | 14 | 19 |
| Elmendorf Tear, g-cm | | | |
| MC | | 24.8 | 16.7 |
| CD | | 24.7 | 11.7 |
| Mullen Burst, psi | | 24.4 | 15.3 |
| Water Pickup, % | | 14.1 | 10.3 |
| Toluene Pickup, % | | 49.9 | 54.2 |
| Limiting Oxygen Index (L.O.I.) | | 47 | 53 |

EXAMPLE 74

An aqueous dispersion of fiber is prepared at about 4 percent consistency from unbleached northern softwood kraft and water in a Black Clawson Hydrapulper. The crude dispersion is pumped to a refiner chest and refined to a Canadian Standard Freeness of 500 milliliters by recirculation through a Sprout-Waldron Twin-Flow Refiner. Highly filled sheets for Example 74 are prepared from the fiber dispersion, a latex, a filler as identified and a wet strength additive which is a cationic polyamide-epichlorohydrin resin having 12.8 percent nitrogen and a viscosity at 25° C. between 40 and 65 centipoises, all in the proportions shown in Table XVI by use of a Fourdrinier Paper Machine having (a) a 36-inch wide plastic wire, (b) a headbox equipped with a manifold type inlet, a homogenizer roll and a Neilson slice, (c) a suction couch roll, (d) a straight-through plain press, (e) a plain reversing press, (f) a dryer section consisting of 7 and 5 driers with integrally cast journals and 2 felt driers on the bottom and top first section felts and (g) a calendar stack consisting of 8 rolls with the intermediate rolls bored for steam. The fiber dispersion, filler, wet strength additive, water and the latex diluted to 25 percent solids are added to a machine chest, in that order, with the amount of added water being calculated to provide 4 percent consistency. The resulting stock is transferred with the aid of a stock pump through a stock valve and then through a fan pump to the headbox. The flocculant shown in Table XVI is added between the stock pump and the stock valve and some white water from the later stages of the process is returned to the system between the stock valve and the fan pump so that the consistency of the furnish in the headbox is as shown in Table XVI. The furnish from the headbox is fed onto the wire moving at 40 feet per minute where white water drains to form a wet sheet from which additional water is removed by means of suction boxes before the sheet is removed from the wire at the suction couch roll. After the two press stages have reduced the water content still further, the sheet is fed through the dryer and calendar stack. Data for the process and property data for the highly filled sheets thus formed are shown in Table XVI.

TABLE XVI

| | | Example 74 |
|---|---|---|
| Filler B, % (solids basis) | | 82.5 |
| Latex N, % (solids basis) | | 7.5 |
| Fiber E, % (solids basis) | | 10.0 |
| Flocculant E, lb/ton of solids | | 0.9 |
| Chest consistency, % | | 4.0 |
| Headbox consistency, % | | 1.7 |
| Headbox Canadian Standard Freeness, ml | | 568 |
| Machine speed, fpm | | 40 |
| Wet Pressing, | 1st press, pli | 100 |
| | 2nd press, pli | — |
| Retention % | | >90 |
| Caliper, mils | | 23.0 |
| Density, Lb/Ft$^3$ | | 50.1 |
| Tensile, | MD, psi | 1600 |
| | CD, psi | 650 |
| Stiffness, | CD Taber | 48 |
| Elmendorf Tear, g-cm | | |
| | MD | 136 |
| | CD | 160 |
| Mullen Burst, psi | | 37 |
| Kerosene Pickup, % | | 64.4 |

The various tests are carried out as described below with such further modifications as are shown in specific examples.

Canadian Standard Freeness (CSF)

The value, in milliliters, is determined according to TAPPI Standard T 227-M-58 on a sample containing 3 grams of solids diluted with water to 1000 milliliters.

Elmendorf Tear

The test is carried out according to TAPPI method T414-ts-65. Results are shown as an average of at least 3 samples.

Elongation, percent

The elongation at room temperature, elongation at 350° F. (177° C.) (hot), elongation DOP and elongation water are determined over a 6-inch span at the same time as the respective Tensile tests—see description below.

Limiting Oxygen Index (L.O.I.)

The L.O.I. is determined according to test method ASTM D 2863-74.

Mullen Burst

The TAPPI test method D 403-os-76 is followed except the test is applied to thicker sheets. The results shown are an average of 4 or 5 samples.

Retention, percent

The materials for the handsheets are added in amounts sufficient to provide sheets weighing 100 grams. Thus, the dry weight of the product also represents the percent retention of solids in the sheet.

For the sheets made on the Fourdrinier machine, the percent retention relates to the proportion of filler retained in the sheet. Combustion of test samples is carried out under conditions such as to retain the residue of the filler (calculated as percent ash) but to remove the other components. The percent ash is multiplied by an appropriate factor for changes in the filler caused by combustion (e.g., $Mg(OH)_2 \rightarrow MgO$) to determine the percent filler in the sheet. From the percent filler found in the sheet and the percent filler added (solids basis), the percent retained in the sheet is calculated as an average of three samples.

Stiffness, Taber

Taber Stiffness (g-cm) is determined according to TAPPI standard method T 489-os-76 except that test results from three samples are averaged unless otherwise stated. The value obtained is corrected to a value for 30 mils thickness by multiplying by the factor:

$$\frac{(30)^3}{(\text{thickness of the test sample in mills})^3}.$$

To distinguish from modified Taber stiffness tests (DOP and water—as described below), the TAPPI method is sometimes referred to herein as "Taber Stiffness, Reg.".

Stiffness, DOP

The DOP stiffness (g-cm) is determined in the same manner as the Taber Stiffness except that the sample is soaked in dioctyl phthalate for 18–24 hours before testing and the reported value is the average of 2 samples.

Stiffness, Water

The water stiffness is determined in the same manner as the Taber Stiffness except that the sample is soaked in water for 18–24 hours before testing and the reported value is the average of two samples.

Tensile, Room Temperature (R.T.)

Sheets are cut into 1-inch by 8-inch strips and the minimum thickness over the test area is determined. The strip being tested is placed in an instron test machine having a 6-inch span. While the Instron is operated at a head speed of one inch per minute, the elongation and pounds at break are recorded.

The pounds per square inch (psi) at break are calculated by dividing the tensile at break by the thickness of the sample. Results are reported as an average of 3 samples.

Tensile, Hot

The hot tensile is tested in the same manner as room temperature tensile except that just before the test, the test specimen is heated at a temperature of 350° F. (177° C.) for one minute while clamped in the jaws of the test machine.

Tensile, DOP

The DOP tensile is tested in the same manner as the room temperature tensile except that the test sample is soaked in dioctyl phthalate for 24 hours before testing.

Tensile, Water

The water tensile is determined in the same manner as the DOP tensile, except the soaking is in water.

Toluene Pickup

A suitable specimen (2 inches by 4 inches) is soaked for 15 seconds in toluene, the weight pickup is recorded and the pickup in percent by weight is calculated.

Kerosene Pickup

The kerosene pickup is measured in the same manner as the toluene pickup except the soaking is in kerosene.

Water Pickup

The water pickup is determined in the same manner as the toluene pickup except that the soaking is in water for 24 hours.

Water Swell

The water swell is determined in the same kind of specimen as used for the water pickup and is calculated on the increase in length of the specimen resulting from soaking in water for 24 hours.

Charge/Mass Ratio

The bound charge per gram of polymer in a latex is measured by conductometric titration after the water-soluble ionic materials have been removed. If sufficient bound charge is present, the latex can be centrifuged, often after adding, for example, 3 percent (based on the latex solids) of carbon tetrachloride, the serum phase is separated, the remaining solids are washed and then redispersed by vigorous agitation in water. The conductometric titrations are made on the redispersed solids. Ion exchange methods also may be used to remove the ionic water-soluble materials from latexes having sufficient bound charge to remain stable until the conductometric titration is completed. For latexes having insufficient bound charge to remain stable, small amounts of non-ionic surfactants are added before the ion exchange procedure.

What is claimed is:

1. A method for preparing a sheet comprising:

(I) providing an aqueous dispersion of from about 1 percent to about 30 percent of a water-dispersible fiber;

(II) mixing therewith (A) from about 60 percent to about 95 percent of a finely-divided, substantially water-insoluble, non-fibrous, inorganic filler and (B) from about 2 percent to about 30 percent of a binder containing a film-forming, water-insoluble, organic polymer in the form of an ionically stabilized latex having not greater than 0.7 milliequivalent of bound charge per gram of polymer in the latex;

(III) colloidally destabilizing the resulting mixture to form a fibrous agglomerate in aqueous suspension having the characteristics that at a concentration of 100 grams of solids in 13,500 milliliters, the suspension will drain in a time of from about 4 seconds to about 120 seconds in a 10-inch by 12-inch Williams Standard Sheet Mould having a 2-inch outlet and a 30-inch water leg and fitted with a 100-mesh, stainless steel screen having a wire diameter of 0.0045 inch to provide in one pass at least 85 percent retention of solids which contain at least 60 percent by weight of filler;

(IV) distributing and draining the aqueous suspension on a porous support to form a wet web; and (V) drying the web; said ionically stabilized latex being devoid of sufficient non-ionic stabilization to interfere with formation of the fibrous agglomerate; said percentages being on a dry weight basis, calculated on the total dry weight.

2. The method of claim 1 in which the aqueous dispersion of fiber has a consistency of from about 0.1 percent to about 6 percent.

3. The method of claim 1 in which the aqueous dispersion of fiber has a consistency of from about 0.5 percent to about 3 percent.

4. The method of claim 1 in which the latex is anionic.

5. The method of claim 1 in which the latex is cationic.

6. The method of claim 1 in which the fiber is cellulosic.

7. The method of claim 6 in which the aqueous dispersion of fiber has a Canadian Standard Freeness at 0.3 percent consistency of from about 300 milliliters to about 700 milliliters.

8. The method of claim 1 which has the additional step of wet pressing the web.

9. The method of claim 1 in which the amount of the fiber is from about 5 percent to about 15 percent.

10. The method of claim 1 in which the amount of latex is from about 5 percent to about 15 percent.

11. The method of claim 1 in which the amount of filler is from about 70 percent to about 90 percent.

12. The method of claim 1 in which the latex contains copolymerized styrene and butadiene.

13. The method of claim 1 in which the latex contains a copolymer of an ethylenically unsaturated carboxylic acid.

14. The method of claim 1 in which the drain time is from about 15 seconds to about 60 seconds.

15. The method of claim 1 in which the drain time is from about 30 seconds to about 45 seconds.

16. The method of claim 1 in which the destabilizing step is carried out by mixing with the product of steps (I) and (II) a sufficient amount of water-soluble or water-dispersible, ionic compound or polymer having a charge opposite in sign to that of the ionic stabilization of the latex.

17. The method of claim 1 in which the filler is magnesium hydroxide.

18. The method of claim 1 in which the fiber includes a polyester fiber.

19. The method of claim 1 in which the fiber includes fibrillated polyethylene.

20. The method of claim 1 in which the fiber includes glass fibers.

21. The method of claim 1 in which the latex is a blend of at least two different latex compositions.

22. The method of claim 21 in which at least one of the latexes contains a copolymer of an ethylenically unsaturated carboxylic acid.

23. The method of claim 1 which is asbestos-free.

24. The method of claim 1 in which the organic polymer has a bound charge of from about 0.03 to about 0.4 milliequivalent per gram of polymer in the latex.

* * * * *

UNITED STATES PATENT AND TRADEMARK OFFICE

CERTIFICATE OF CORRECTION

PATENT NO. : 4,225,383

DATED : September 30, 1980

INVENTOR(S) : Kent B. McReynolds

It is certified that error appears in the above—identified patent and that said Letters Patent is hereby corrected as shown below:

Column 1, line 37, delete "comtemplated",insert --contemplated--
Column 3, line 19, delete "collodial",insert --colloidal--
Column 4, line 68, delete "ble,",insert --ble--
Column 7, line 60, delete "proces",insert --process--
Column 10, line 59, delete "Latex",insert --latex--
Column 14, Table I, footnote (a), insert --%--after "0.1"
Column 15, Table III, Ex. No. 40, fourth column, delete "P", insert --D--
Column 16, Table VII, second heading under "Flocculant" delete "(b)", insert --A(b)--
Column 17, Table X, last example No., delete "A-1*", insert --A-2*--
Column 21, Table XV under Example 73, delete "4.1", insert --4.0--
Column 26, line 14, insert --a-- before "water-soluble"

Signed and Sealed this

*Fourteenth* Day of *July 1981*

[SEAL]

*Attest:*

GERALD J. MOSSINGHOFF

*Attesting Officer*

*Commissioner of Patents and Trademarks*